United States Patent [19]

Dickakian

[11] Patent Number: 4,619,756

[45] Date of Patent: Oct. 28, 1986

[54] METHOD TO INHIBIT DEPOSIT FORMATION

[75] Inventor: Ghazi B. Dickakian, Kingwood, Tex.

[73] Assignee: Exxon Chemical Patents Inc., Florham Park, N.J.

[21] Appl. No.: 786,929

[22] Filed: Oct. 11, 1985

Related U.S. Application Data

[63] Continuation of Ser. No. 722,865, Apr. 11, 1985, abandoned.

[51] Int. Cl.[4] ..... C10G 9/16

[52] U.S. Cl. ..... 208/48 AA; 208/48 R; 208/106; 585/648

[58] Field of Search ..... 585/648; 208/48 R, 48 AA, 208/106

[56] References Cited

U.S. PATENT DOCUMENTS

| | | | |
|---|---|---|---|
| 3,269,808 | 8/1966 | Churchill et al. | 208/48 AA |
| 3,619,407 | 11/1971 | Grant et al. | 208/48 R |
| 4,116,812 | 9/1978 | Godar et al. | 208/48 AA |
| 4,447,315 | 5/1984 | Lamb et al. | 208/48 R |

*Primary Examiner*—Andrew H. Metz
*Assistant Examiner*—A. Pal
*Attorney, Agent, or Firm*—R. L. Graham

[57] ABSTRACT

Deposit formation on the contact surfaces of structures containing heated hydrocarbon fluids such as refinery units, particularly units associated with the distilling process such as preheating stages, is inhibited by incorporating in the feed stock from 0.0001 to 0.01 weight percent of thiophene-containing polycondensed aromatic/naphthenic compounds of number average molecular weight ($\overline{M}n$) from 200 to 1000 and if desired at least one other additive such as an oil-soluble dispersant, antioxidant, antipolymerant, antifoulant and mixtures thereof into said hydrocarbon stream.

20 Claims, No Drawings

METHOD TO INHIBIT DEPOSIT FORMATION

This is a continuation of application Ser. No. 722,865, filed 4/11/85, now abandoned.

The present invention relates to improvements in antifoulant processes for vessels containing heated hydrocarbon fluids such as liquid petroleum hydrocarbons. In a more particular sense, it relates to a method for inhibiting the accumulation of harmful carbonaceous material in refinery process equipment and the concomitant impairment of heat transfer in such equipment in which normally liquid feedstocks are used.

BACKGROUND OF THE INVENTION

The production of refinery products such as the various oil fractions, fuels and solvents involve the preheating of crude oils to from 150° C. to 350° C. prior to distillation into various fractions followed by subsequent exposure of said fractions to higher temperatures of 350° C. to 700° C. As an illustration, most of the gasoline produced today is obtained by the thermal or catalytic cracking of heavier petroleum hydrocarbon feed stocks such as light or heavy gas oils, cycle stocks, virgin or topped crude oils, lub stocks, kerosene, and kerosene-gas oil mixtures. A number of different thermal and/or catalytic cracking processes are industrially used for this purpose. Although these various processes differ considerably as to the precise manner in which the heavier hydrocarbon molecules are cracked to yield gasoline, they all involve the heating of the hydrocarbon feed stock to a high temperature (150°-370° C.) and the passage of such heated stock, optionally mixed with a cracking catalyst, through heated tubes, reactors, convertors, and tower stills.

Regardless of the refinery process used, the distillation and/or cracking operation (particularly the former) always results in the formation of undesirable carbonaceous material which accumulates on the inner surfaces of the process equipment, e.g., preheating units, preheating and/or cracking unit and markedly reduces heat transfer efficiency, substantially increases the pressure drop of the hydrocarbon stream and blocks the process flow. This fouling of heat exchangers or other process equipment, such as furnace tubes, is a costly, major, unresolved problem throughout refineries and petrochemical plants since the fouled units must be dismantled, cleaned, and reassembled. Of course, such cleaning operations are not only tedious and costly, but result in a large proportion of "down-time" during which the subject unit is not functioning.

Generally, the carbonaceous deposition can be separated into the lower temperature (<400° C.), long time (minutes to hours) deposits which are hexane insoluble and quinoline soluble and the higher temperature (>750° C.), short time (seconds) coke deposits which are hexane insoluble and quinoline insoluble.

Antifoulant processes to reduce (inhibit) quinoline-soluble carbonaceous deposits include those set forth in: U.S. Pat. No. Re. 26,330 wherein deposit formation in refinery units is inhibited by incorporating in the feed stock a small percentage (usually about 0.0012-0.04 weight percent) of an acylated amine prepared by reacting a hydrocarbon-substituted succinic acid with an alkylene amine; and, U.S. Pat. No. 4,195,976 wherein fouling of process equipment by an oil stream in refinery operations is reduced by incorporating in the feed from 0.001 to 2 wt. % of a bis-oxazoline reaction product of polyisobutenylsuccinic anhydride with a 2,2 disubstituted-2-aminolalkanol, such as tris-hydroxy methylaminomethane.

Approaches to the reduction of coke (carbonaceous coating insoluble in both quinoline and hexane) formation in cracking furnace tubes includes: U.S. Pat. No. 2,621,216 which discloses that coke formation during steam pyrolysis of ethane, propane, or mixtures thereof may be reduced by incorporating from 0.2 to 0.5 volume percent of a sour refinery gas (containing $H_2S$) in the pyrolysis feedstock (Col. 7, line 19-75); U.S. Pat. No. 3,437,174 which discloses that incorporation of up to 25% propylene in a naphtha pyrolysis feedstock improves yield selectivity to ethylene without any increase in coking (Col. 2, line 31-48); U.S. Pat. No. 3,536,776 which discloses that thermal cracking of hydrocarbons, may be carried out in a metal-ceramic reaction tube with significantly reduced carbon formation (Col. 2, line 5-13 and line 56-63 and Col. 4, line 27-42); U.S. Pat. No. 3,842,138 which discloses that, in steam cracking, the carbon to hydrogen ratio of the feedstock is important with respect to coking, aromatics can only be tolerated in the feedstock because of their refractory nature, and small amounts of sulfur in feedstock have a favorable effect against coking (Col. 4, line 37 to Col. 5, line 2); and, Green et al in *Hydrocarbon Processing*, September 1975, pp. 164-168, at page 165 contends that gas oil cracking is disadvantageous compared with naphtha cracking because of lower yields and because higher yields of pyrolysis fuel oil are produced which contain highly aromatic material that is a precursor of tars and coke; whereas, U.S. Pat. No. 4,176,045 discloses that a blending (4 to 20%—see Table 2-5) amounts of low coking liquid hydrocarbon, such as pyrolysis fuel oil with the feedstock prior to introducing the latter into the tubular furnace reduces coke formation.

It is an object of the present invention to inhibit the accumulation of harmful carbonaceous material on the inner surfaces of vessels confining a heated hydrocarbon fluid.

Another object is to disperse the carbonaceous material formed during the preheating of a crude oil and thereby inhibit its accumulation (fouling) on the various parts of the inner wall of the heat exchanger prior to its introduction into a crude distillation unit.

Yet another object is to reduce the amount of downtime, reduce fuel costs and/or increase hydrocarbon throughput in the operation of refinery heat exchangers and cracking units.

SUMMARY OF THE INVENTION

In accordance with the objects of this invention, there is provided an hydrocarbon process stream in refinery operations which has been inhibited to prevent fouling of process equipment by incorporation of at least an antifouling amount of oil-soluble, thiophene-containing polycondensed aromatic/naphthenic compounds of number average molecular weight ($\overline{M}n$) from 200 to 1000 and, if desired, at least one other additive such as an oil soluble dispersant, antioxidant or antipolymerant into said oil stream. It has been discovered that introducing from 25 to 100 parts per million (hereinafter ppm) of an alkylated thiophene-containing polycondensed aromatics/naphthenic compounds of number average molecular weight from 200 to 1000 into a heated hydrocarbon stream such as crude oil or crude residue reduces the tendency of said hydrocarbon stream to deposit carbonaceous material on the hydrocarbon contacted surface of a heater exchanger, furnace tube, reactor wall and other processing equipment through which said heated stream flows. Since it has been discovered that the oil-soluble, thiophene-containing, polycondensed aromatic/naphthenic compounds of 200 to 1000 Mn can be recovered from various sources, it is within the concept of the process of the invention to use sources in amounts appropriate to provide antifouling activity. It is also within the scope of the invention to include a method for recovering the aforesaid compounds from various refinery stream sources as by high performance liquid chromatography or liquid-liquid extraction.

DETAILED DESCRIPTION OF THE INVENTION

The antifouling agent which is the subject of this invention is composed of polycondensed aromatic/naphthenic compounds with thiophenic structures, preferably alkylated ($C_2$–$C_{12}$) polycondensed aromatic/naphthenic compounds with thiophenic structure having a number average molecular weight ranging from 200 to 1000. These compounds are basically composed of hydrocarbon and sulfur, but may contain small quantities of other polar atoms such as oxygen and nitrogen. The composition and the chemical structure of the antifouling agent can be defined quantitatively by a number of analytical methods including carbon and proton nuclear magnetic resonance spectroscopy, high-resolution mass spectroscopy, high-performance liquid chromatography and thermal analysis.

The antifouling agent can be synthesized or derived from various hydrocarbon streams in the petroleum, chemical and coal industries as by fractionation. These streams can be used alone, or blends of the fractions obtained by atmospheric, steam or vacuum distillation, or liquid-liquid extraction. Useful streams may be obtained from one or more of the following sources: thermal or catalytic cracking of petroleum distillates; steam cracking of naphtha and gas oil; coal processing including liquefication, gasification and carbonization; and, aromatic extracts from lubricating oil processing.

The useful streams are characterized by the presence of alkylated ($C_2$–$C_{12}$) polycondensed aromatic/naphthenic thiophenic compounds with ($\overline{M}n$) of 200 to 1000, preferably from 200 to 300, which typically have a boiling range from 200° C. to 550° C. at atmospheric pressure and which are found in combination with sulfur-free compounds of similar structures. As indicated, the various sources of the antifouling agent which is used in this invention provide a stream which contains two major components according to high resolution mass spectroscopic analysis. One component is composed of sulfur-free compounds having a formula ranging from $C_nH_{2n-8}$ to $C_nH_{2n-36}$. The second major component is a thiophene containing alkylated polycondensed aromatic/naphthenic compounds with the molecular formula ranging from $C_nH_{2n-12}S$ to $C_nH_{2n-36}S$.

Another method to characterize a stream useful as an antifouling additive according to the invention is provided by high performance liquid chromatography wherein the stream is fractionated using specific chromatographic columns into a saturate fraction, a neutral aromatic fraction and a polar aromatic fraction. Generally, the streams which are useful as antifouling agents contain 29 to 43% of a saturate fraction, 7 to 56% of neutral aromatic fraction and 14 to 48% of a polar aromatic fraction.

The antifouling amount of the antifouling agent needed to inhibit fouling will depend upon its chemical structure and its concentration in the stream being processed. A useful treatment range of the agent for the hydrocarbon fluid is from 0.0001 to 0.5, preferably 0.0001 to 0.1, optimally 0.0008 to 0.003, weight percent based on the weight of the hydrocarbon fluid.

The other additives which can be used in combination with the antifouling agent useful in this invention are dispersants, antioxidants, antipolymerants or free-radical scavengers, other antifoulants and mixtures thereof.

Suitable representative dispersants include the acylated nitrogen compounds such as polyisobutylene succinimides of polyalkylene polyamines (see U.S. Pat. No. 3,272,746) and their borated derivatives, esters of long chain dicarboxylic acids such as polyisobutenylsuccinic anhydride esterified with a polyol, such as pentaerythritol (see U.S. Pat. No. 3,381,002) or with a hydroxy amine, such as ethanolamine (see U.S. Pat. No. 3,272,746), mono and bis oxazolines of polyisobutenyl succinic anhydride (see U.S. Pat. No. 4,049,564) lactone esters reaction products of hydrocarbon substituted lactone carboxylic acid with polyols (see U.S. Pat. No. 4,123,373), thiobisacyl esters (see U.S. Pat. No. 4,417,062), sulfonates and sulfonic acids such as $C_{28}$–$C_{32}$ alkyl benzene sulfonic acid (see U.S. Pat. No. 4,182,613) and thio-bis-oxazolines (see U.S. Pat. No. 4,292,184).

Representative antioxidants are the zinc dihydrocarbylsubstituted dithiophosphates such as zinc dinonylphenyl dithiophosphates such as zinc dinonylphenyl dithiophosphate (see U.S. Pat. No. 4,085,053), nonyl phenol sulfide, the known class of hindered amines such as N-phenyl naphthylamine, tri alkyl tri aryl phosphite, trithiones produced by the reaction of an olefin such as diisobutylene and triisobutylene with elemental sulfur, tert-octyl phenol sulfide, 4,4'-methylene bis(2,6-ditert-butyl phenol), fatty acid thiocyanates such as lauroyl thiocyanate and stearoyl thiocyanate (see U.S. Pat. No. 2,168,674) and thiocarbamyl derivatives (see U.S. Pat. No. 4,303,539).

Suitable antipolymerants are such as phenolic derivative, e.g., 2,6-di-tert-butyl phenol and its derivatives such as 4,4,'-methylene-bis-(2,6-di-tert-butylphenol) or other molecules which can be used to act as free radical scavenger known in the arts.

Antifoulants of those types sold in commerce as antifoulants and generally derived from polyisobutylene succinic anhydride, including various amines, polyamines and hydroxyamine derivatives, are useful in combination with the antifouling agent and include the macrocyclic polyamine having 2 to 8 nitrogen atoms per molecule as described in U.S. patent application Ser. No. 675,372 filed Nov. 27, 1984, particularly when present in amounts up to 100 ppm, e.g., 5 to 50 ppm, along with said agent.

Generally, the antifouling agent is used with from 0.1 to 10, preferably 1 to 8 weight parts of agent to each total weight part of other additive(s).

Although the process of this invention is applicable to all crude stocks and refined hydrocarbon liquids generally found in a refinery, it is particularly useful for fouling inhibition of those crude stocks containing less than 50, more particularly less than 40 and highly applicable for less than 30, weight percent total aromatic content of the liquids as determined by high performance liquid chromatography.

The process of the invention is also particularly useful for the treating of those oils heated to temperatures of less than about 400° C. When the oils are so heated for periods of minutes to hours, e.g., in the preheating of crude oil prior to its passage into the primary distillation tower and/or the heat removal from the bottoms flow from said tower, the carbonaceous fouling layer which develops to detrimental thicknesses in months is quinoline soluble. In contrast, a coke layer is neither quinoline nor hexane soluble. Thus, the formation of a quinoline soluble fouling layer such as is found in heat exchangers and similar process equipment is particularly effectively inhibited when oils subjected to heating temperatures of less than about 400° C. are processed according to this invention.

All of the following Examples cited herein demonstrating the fouling characteristics of treated and untreated crude utilized a laboratory test apparatus identified herein as a Thermal Fouling Tester.

The Tester is a modification of the Alcor Jet Fuel Oxidation Tester described in ASTM Vol. 50 D-3241. It is configured to allow measurement of the fluid temperature at the exit of the heat exchanger while the metal temperature of the heated tube is controlled. The test thus measures the change in temperature of a fluid which has been pumped across a heated surface. The outlet temperature is directly related to the heat transferred to the fluid. If fouling occurs, a deposit adheres to the heated surface and insulates a portion of the surface from the test fluid. The insulating deposit reduces the rate of heat transfer to the fluid and its temperature decreases. The rate of change in the fluid temperature is a measure of the rate of fouling.

The time over which temperature measurements are recorded was set at 3 hours. By doing this, the changes in temperatures of several fluids can be used as a measure of their relative fouling tendencies.

When testing the antifoulant activity of additives, the conditions are set so as to allow the fluid temperature at the outlet to drop about 50° F. during the test period. Except for the most unstable fluids, the temperature of the heated surface is normally significantly higher than that in the field application in order to effect fouling within the time of the test. Because of this acceleration of the test, the results are qualitative.

The following Examples are provided for illustrative purposes only and are not to be construed as limiting the invention herein described.

EXAMPLES 1-14

In carrying out the tests of the Examples, a crude oil was utilized which was a blend of primarily West Texas Sour crudes and had the following general characteristics:

TABLE I

| | |
|---|---|
| $C_7$Asphaltenes (Wt. %) | 0.80-2.0 |
| Elemental Analysis | |
| Carbon (Wt. %) | 85.32 |
| Hydrogen (Wt. %) | 12.86 |
| Oxygen (Wt. %) | 0.56 |
| Nitrogen (Wt. %) | 0.11 |
| Sulfur (Wt. %) | 1.17 |
| Toluene Insolubles (Reflux) | |
| Wt. % | 0.050 |
| Liquid Chromatography | 0.050 |
| Saturates (%) | 77-86 |

TABLE I-continued

| | |
|---|---|
| Neutral Aromatics (%) | 10-17 |
| Polar Aromatics (%) | 3-8 |

This crude oil was exposed to the following test conditions in the thermal Fouling Tester.

| | |
|---|---|
| Metal temperature (°C.) | 372 |
| Oil Circulation rate (cc/min) | 3.0 |
| Preheating (°C.) | 21 |
| Pressure (psig) | 500 |
| Time (hours) | 3.0 |

In each test, the additive used was obtained from a liquid stream from a refinery catalytic cracking unit containing a preponderance of alkylated thiophene-containing polycondensed aromatics/naphthenic compounds as seen from its mass spectrometric analysis (Table II) and having boiling ranges as specified in the Examples.

TABLE II

| Molecular Formula | Typical Name | Wt. % | ($\overline{M}$n) |
|---|---|---|---|
| $C_nH_{2n-16}$ | Acenaphthenes | 1.54 | (218) |
| $C_nH_{2n-18}$ | Phenanthrenes | 8.95 | (243) |
| $C_nH_{2n-20}$ | Naphthenophenanthrenes | 9.78 | (254) |
| $C_nH_{2n-22}$ | Pyrenes | 15.40 | (253) |
| $C_nH_{2n-24}$ | Chrysenes | 8.70 | (265) |
| $C_nH_{2n-26}$ | Cholanthrenes | 2.90 | (283) |
| $C_nH_{2n-14}S$ | Benzothiophenes | 1.00 | (295) |
| $C_nH_{2n-16}S$ | Indothiophenes | 1.45 | (280) |
| $C_nH_{2n-18}S$ | Naphthenonaphthothiophenes | 4.70 | (249) |
| $C_nH_{2n-20}S$ | Acenaphthyleneothiophenes | 4.00 | (273) |
| $C_nH_{2n-22}S$ | Anthracenothiophenes | 3.80 | (261) |
| $C_nH_{2n-24}S$ | Naphthenophenanthreno-thiophenes | 9.90 | (271) |
| $C_nH_{2n-26}S$ | Pyrenothiophenes | 1.20 | (295) |
| $C_nH_{2n-28}S$ | Chrysenothiophenes | 0.82 | (295) |
| $C_nH_{2n-30}S$ | Cholanthrenothiophenes | 0.50 | (299) |

The efficacy in inhibiting the accumulation of carbonaceous material on a preheater tube is indicated by the change in final temperature (ΔT) in °F. Table III illustrates the anti-fouling activity of the process of the invention when practiced on the crude oil as earlier described. Examples 1 through 15 compare the fouling characteristics of the crude oil without additive (Examples 1-6) with the reduced fouling provided by the addition of the described additives above (Examples 7-10) alone and in combination with an additional antifoulant additive as described and identified in (Examples 11-14).

TABLE III

| Example | Additive Boiling Range (°C.) | Additive Dosage (PPM) | Fouling ΔT (F) |
|---|---|---|---|
| 1 | None | 0 | 38 |
| 2 | None | 0 | 40 |
| 3 | None | 0 | 38 |
| 4 | None | 0 | 41 |
| 5 | None | 0 | 41 |
| 6 | None | 0 | 38 |
| 7 | 270-399 | 25 | 11 |
| 8 | 427-455 | 25 | 22 |
| 9 | 427-520 | 25 | 21 |
| 10 | 270-520 | 25 | 19 |

| Example | Additive Blend Composition (% by weight) (A)[1] | Solvent[2] | (B)[3] | Additive Blend (PPM) | Fouling ΔT (°F.) |
|---|---|---|---|---|---|
| 11 | 11.8 | 76.4 | 11.7 | 25 | 24 |

TABLE III-continued

| | | | | | |
|---|---|---|---|---|---|
| 12 | 11.8 | 76.4 | 11.8 | 25 | 21 |
| 13 | 24.1 | 64.1 | 11.8 | 25 | 21 |
| 14 | 25.9 | 50.5 | 23.6 | 25 | 14 |

[1]The boiling range of stream A (additive of the invention) was 427° C.–520° C. for Examples 11 and 12 and 270° C.–520° C. for Examples 13–14.
[2]The solvent was kerosene.
[3]The additive B was polyisobutyenyl succinimide of polyalkylene polyamine in an oil diluent.

What is claimed is:

1. A process for inhibiting deposit formation on the contact surfaces of structures confining heated hydrocarbon fluid which exhibits substantial fouling comprising the step of introducing into said hydrocarbon fluid at least an inhibiting amount of thiophene-containing polycondensed aromatic/naphthenic compounds of number average molecular weight ($\overline{M}n$) from 200 to 1,000.

2. A process for preventing heat transfer reduction in a metal conductor through which passes a heated liquid hydrocarbon stream which exhibits substantial fouling comprising the step of introducing into said stream from 0.0001 to 0.01 weight percent, based on the weight of said stream, of oil-soluble, alkylated ($C_2$–$C_{12}$), thiophene-containing, polycondensed aromatic/naphthenic compounds of number average molecular weight ($\overline{M}n$) ranging from 200 to 1000.

3. A process according to claim 1 wherein said compounds are introduced as a refinery stream containing said compounds having a boiling range within the range of from 200° C. to 550° C. at atmospheric pressure.

4. A process according to claim 1 wherein there is also introduced with said compounds at least one other oil-soluble additive of the class of dispersants, antioxidants, antipolymerants, antifoulants and mixtures thereof.

5. A process according to claim 4 wherein said other additive is polyisobutyenyl succinimide of an alkylene polyamine.

6. A method for reducing the fouling of metal surfaces by a heated liquid petroleum stream, which exhibits the formation of undesirable carbonaceous material which markedly reduces heat transfer efficiency comprising introducing into said petroleum stream an inhibiting amount of oil soluble, alkylated ($C_2$–$C_{12}$), thiophene-containing polycondensed aromatic/naphthenic compounds of number average molecular weight ranging from 200 to 1000 and having a boiling range from 200° C. to 550° C.

7. The process according to claim 1 wherein said hydrocarbon fluid comprises crude oil containing less than 50 wt.% total aromatics.

8. The process according to claim 7 wherein said crude oil contains less than 40 wt.% total aromatics.

9. The process according to claim 8 wherein said crude oil contains less than 30 wt.% total aromatics.

10. The process according to claim 4 wherein said thiophene-containing polycondensed aromatic/naphthenic compounds are present in an amount of from 1 to 8 parts by weight per part by weight of the total of aid additive.

11. The process according to claim 1 wherein said hydrocarbon fluid is heated to less than 400° C.

12. The process according to claim 2 wherein said hydrocarbon stream is heated to less than 400° C.

13. The method according to claim 6 wherein said petroleum stream is heated to less than 400° C.

14. The process according to claim 1 wherein the inhibiting amount is from 0.0001 to 0.5 wt.%.

15. The process according to claim 14 wherein the inhibiting amount is from 0.0001 to 0.1 wt.%.

16. The process according to claim 15 wherein the inhibiting amount is from 0.0008 to 0.003 wt.%.

17. The process according to claim 1 wherein said thiophene-containing polycondensed aromatic/naphthenic compounds are components of a stream characterized as containing 29 to 43% of a saturated fraction, 7 to 56% of a neutral aromatic fraction and 14 to 48% of a polar aromatic fraction.

18. The process according to claim 2 wherein the number molecular weight ranges from 200 to 300.

19. The process according to claim 1 wherein an inhibiting amount is from 25 to 100 ppm.

20. The process according to claim 1 wherein said thiophene-containing polycondensed aromatic/naphthenic compounds are obtained from one or more of thermal cracking of petroleum distillates, catalytic cracking of petroleum distillates, coal liquification, coal gasification, coal carbonization or aromatic extracts from lubricating oil processing.

* * * * *